US005445169A

United States Patent [19]

Brinkley et al.

[11] Patent Number: 5,445,169

[45] Date of Patent: Aug. 29, 1995

[54] PROCESS FOR PROVIDING A TOBACCO EXTRACT

[75] Inventors: Paul A. Brinkley, Winston-Salem; Jack G. Flinchum, Jr., Pfafftown; James S. Thomasson, Statesville, all of N.C.

[73] Assignee: R. J. Reynolds Tobacco Company, Winston-Salem, N.C.

[21] Appl. No.: 931,072

[22] Filed: Aug. 17, 1992

[51] Int. Cl.[6] ..... A24B 15/24

[52] U.S. Cl. ..... 131/297; 131/298

[58] Field of Search ..... 131/297, 298

[56] References Cited

U.S. PATENT DOCUMENTS

| | | | |
|---|---|---|---|
| 1,671,259 | 5/1928 | Schloesing | 131/297 |
| 3,742,962 | 7/1973 | Brochot | 131/17 |
| 3,821,960 | 7/1972 | Egri | 131/143 |
| 4,628,947 | 12/1986 | Driscoll et al. | 131/297 |
| 4,744,375 | 5/1988 | Denier et al. | 131/309 |
| 4,962,774 | 10/1990 | Thomasson | 131/309 |
| 4,986,286 | 1/1991 | Roberts et al. | 131/290 |
| 5,038,802 | 8/1991 | White et al. | 131/297 |
| 5,060,669 | 10/1991 | White et al. | 131/297 |
| 5,074,319 | 12/1991 | White et al. | 131/297 |
| 5,121,757 | 6/1992 | White et al. | 131/297 |
| 5,159,942 | 11/1992 | Brinkley et al. | 131/298 |
| 5,318,050 | 6/1994 | Gonzalez-Parra | 131/297 |

*Primary Examiner*—Jose' G. Dees
*Assistant Examiner*—Samuel Barts

[57] ABSTRACT

Tobacco extracts are provided within a polyhydric alcohol carrier. Tobacco strip is extracted with ammonia and steam to provide a mixture of water, tobacco extract and ammonia. The mixture is contacted with a polyhydric alcohol to provide a resulting mixture. The water then is evaporated from the resulting mixture to provide a mixture of 30 weight parts tobacco extract, 65 weight parts polyhydric alcohol and 5 weight parts water.

5 Claims, 2 Drawing Sheets

PROCESS FOR PROVIDING A TOBACCO EXTRACT

BACKGROUND OF THE INVENTION

The present invention relates to smoking articles, such as cigarettes; and in particular, to methods for providing forms of processed tobacco useful in the manufacture of cigarettes.

Cigarettes, cigars and pipes are popular smoking articles which use tobacco in various forms. Many smoking products have been proposed as improvements upon, or alternatives to, the various popular smoking articles. For example, numerous references have proposed articles which generate flavored vapor and/or visible aerosol. Most of such articles have employed a combustible fuel source to provide an aerosol and/or to heat an aerosol forming material. See, for example, the background art cited in U.S. Pat. No. 4,714,082 to Banerjee et al.

Smoking articles which are capable of providing the pleasures associated with cigarette smoking, by heating but not necessarily burning tobacco, and without delivering considerable quantities of incomplete combustion products, are described in U.S. Pat. No. 4,714,082 to Banerjee et al; U.S. Pat. No. 4,756,318 to Clearman et al; U.S. Pat. No. 4,793,365 to Sensabaugh, Jr. et al; U.S. Pat. No. 4,819,665 to Roberts et al; U.S. Pat. No. 4,854,311 to Banerjee et al; U.S. Pat. No. 4,881,556 to Clearman et al and U.S. Pat. No. 5,027,837 to Clearman et al; and U.S. patent application Ser. Nos. 723,350 filed Jun. 28, 1991 and 873,529, filed Apr. 21, 1992. Such smoking articles employ a combustible fuel element for heat generation; and aerosol forming substances positioned physically separate from, and in a heat exchange relationship with, the fuel element. During use, heat generated by the fuel element acts to volatilize the aerosol forming substances, thereby providing a visible aerosol. Such smoking articles provide for extremely low yields of visible sidestream smoke as well as low yields of FTC "tar". Typically, the aerosol forming substances include tobacco extracts, tobacco flavoring agents and visible aerosol forming materials.

It would be desirable to provide a method for providing an aerosol forming substance, which aerosol forming substance includes a tobacco extract as well as a visible aerosol forming material (e.g., glycerine).

SUMMARY OF THE INVENTION

The present invention relates to a process for providing a tobacco extract. The process involves providing a tobacco extract by treating a tobacco material under extraction conditions with a basic material, such as ammonia. The tobacco material is contacted with the basic material in the presence of an aqueous solvent, and preferably the aqueous solvent has the form of steam. As such, a tobacco extract, basic material and solvent are separated from extracted tobacco material, and are collected. In a preferred aspect, the tobacco extract, basic material and solvent are subjected to conditions sufficient to remove a certain amount of the solvent therefrom. The process further involves contacting the tobacco extract, basic material and solvent with a liquid which has a boiling point significantly greater than water (e.g., a boiling point of at least about 150° C., usually at least about 180° C., and sometimes at least about 250° C., at 1 atmosphere pressure). Such a liquid preferably is a visible aerosol forming material (e.g., a polyhydric alcohol). As such, an intimate mixture of extract, basic material, solvent and visible aerosol forming material results. Then, the intimate mixture is subjected to conditions sufficient to remove a significant amount of the aqueous solvent therefrom. Normally, the intimate mixture is subjected to conditions sufficient to also remove a significant amount of the basic material from the intimate mixture. As such, the intimate mixture which results preferably consists primarily of visible aerosol forming material (e.g., at least about 50 weight percent of the mixture which results is provided by the visible aerosol forming material).

The intimate mixture which is provided according to the process of the present invention is useful in the manufacture of smoking articles. For example, the intimate mixture can be combined with other tobacco extracts and/or with tobacco flavoring agents, and employed as aerosol forming materials in the types of smoking articles described in U.S. Pat. No. 4,714,082 to Banerjee et al; U.S. Pat. No. 4,756,318 to Clearman et al; U.S. Pat. No. 4,793,365 to Sensabaugh, Jr. et al; U.S. Pat. No. 4,819,665 to Roberts et al; U.S. Pat. No. 4,854,311 to Banerjee et al; U.S. Pat. No. 4,881,556 to Clearman et al; U.S. Pat. No. 5,027,837 to Clearman et al; and U.S. patent application Ser. Nos. 723,350 filed Jun. 28, 1991; and 873,529, filed Apr. 21, 1992. For example, the intimate mixture can be applied to alumina, paper, fabric, glass bead, or tobacco substrates.

DETAILED DESCRIPTION OF THE PREFERRED EMBODIMENTS

Figure 1:
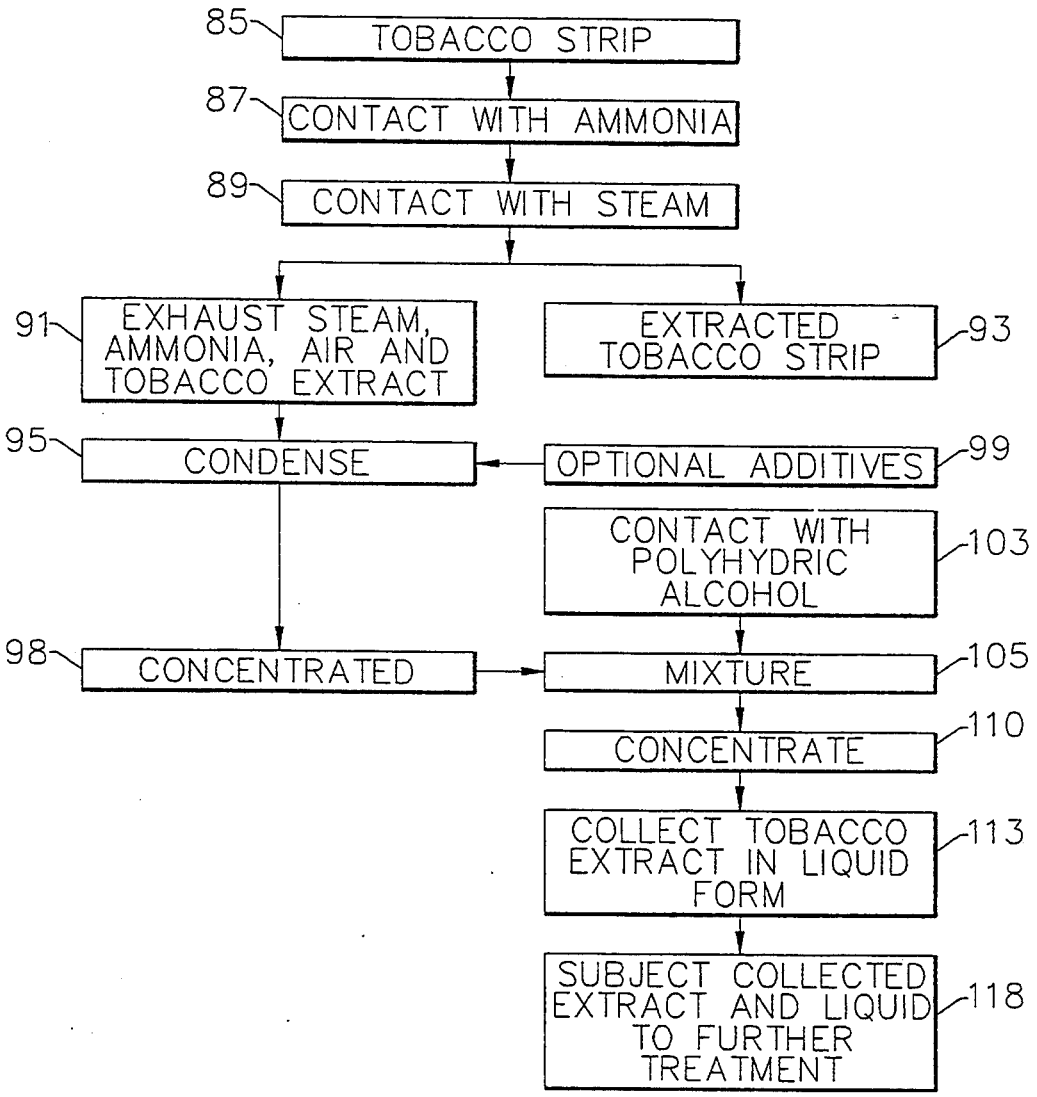
FIG. 1 is a schematic diagram of steps representative of the process of the present invention.

Referring to FIG. 1, there are described steps for providing a tobacco extract. Tobacco strip 85, or tobacco material in any other suitable form, is contacted with ammonia 87 and steam 89. For example, flue-cured tobacco strip can be introduced into a treatment drum and contacted with ammonium hydroxide at ambient temperatures at a concentration of about 0.1 to about 0.5 weight part ammonium hydroxide per weight part of tobacco strip; and each weight part of tobacco strip then is contacted with about 10 to about 30 weight parts steam at about 220° F. to about 280° F. As another example, tobacco strip is contacted with gaseous ammonia or aqueous ammonium hydroxide in a suitable treatment drum, and transferred through an air lock to second treatment or stripping drum where the tobacco material is contacted with steam. As yet another example, Burley tobacco strip can be introduced into a treatment zone and contacted simultaneously with anhydrous ammonia and steam in a countercurrent manner. Treatment drums or zones will be apparent to the skilled artisan, and such drums or zone are equipped with suitable conveyor means, air locks, insulation, etc. Steam, ammonia, air and a tobacco extract is exhausted 91 from the extracted tobacco strip 93. The exhausted steam, ammonia, air and tobacco extract which is separated from the extracted tobacco strip then is condensed 95 in a continuous manner using a scrubber or condenser to provide a liquid extract; normally including about 0.5 to about 4 weight percent tobacco extract, about 0.03 to about 3 weight percent ammonia, and the remainder water. Preferably, the condensed liquid tobacco extract is concentrated 98 (e.g., using reverse osmosis, forced circulation evaporation or wiped film evaporation techniques) to remove a certain amount of the water therefrom. If desired, the condensed liquid tobacco extract can be contacted with additives 99 (e.g., phosphoric acid in amounts sufficient to provide ammonium phosphate salts) either before or after the time that the condensed liquid tobacco extract is concentrated. The condensed liquid tobacco extract then is contacted with a polyhydric alcohol or other suitable visible aerosol forming material 103. Suitable visible aerosol forming materials are those which have a liquid form under ambient conditions, act as a carrier or solvent for the tobacco extract, and have a boiling point which is significantly higher than that of water. Thus, an intimate mixture 105 of water, tobacco extract, ammonia and visible aerosol forming material is provided. The various components of the mixture can be mixed using stirring units, agitators, static mixers, or the like, in order to provide a well dispersed mixture of homogeneous solution. The mixture also can be heat treated as set forth in U.S. patent application Ser. No. 710,273, filed Jun. 4, 1991. The heat treatment can be performed in a pressure controlled environment as set forth in U.S. Pat. Nos. 5,060,669 and 5,121,757 to White et al. The mixture can be mixed at ambient temperature, however the mixture can be heated somewhat (e.g., to about 100° F. to about 150° F.). The intimate mixture 105 is concentrated 110 so as to evaporate water and any remaining ammonia, and provide a concentrated liquid tobacco extract 113, having a tobacco extract content of about 4 to about 8 weight percent. The manner in which the condensed liquid tobacco extract is concentrated can involve the use of wiped film evaporation techniques, reverse osmosis techniques, forced circulation evaporation techniques, or the like. Exemplary techniques involve subjecting the mixture to rotary evaporation treatment at a temperature above about 180° F. and at a pressure of less than about 30 mm Hg. During concentration, at least a portion, and in certain circumstances essentially all, of the ammonia is removed from the liquid extract. During concentration, a significant amount, and in certain circumstances, essentially all of the water is removed from the liquid extract. As such, the extract remains dissolved, dispersed or otherwise contained in the visible aerosol forming material. If desired, the concentrated liquid tobacco extract 113 can be subjected to further treatment 118. The concentrated liquid tobacco extract can be subjected to heat treatment in a pressure controlled environment as set forth in U.S. Pat. Nos. 5,060,669 and 5,121,757 to White et al. Alternatively, the liquid extract can be heated to about 180° F. to about 250° F. for about 10 to about 90 minutes, particularly after an additive (e.g., phosphoric acid) has been added thereto. The concentrated liquid tobacco extract can be contacted with additives, if desired (e.g., the liquid extract can be contacted with phosphoric acid), particularly if not all of the ammonia is removed therefrom during concentration. Alternatively, the concentrated liquid tobacco extract can be contacted with a further tobacco extract, such as a spray dried tobacco extract.

Figure 2:
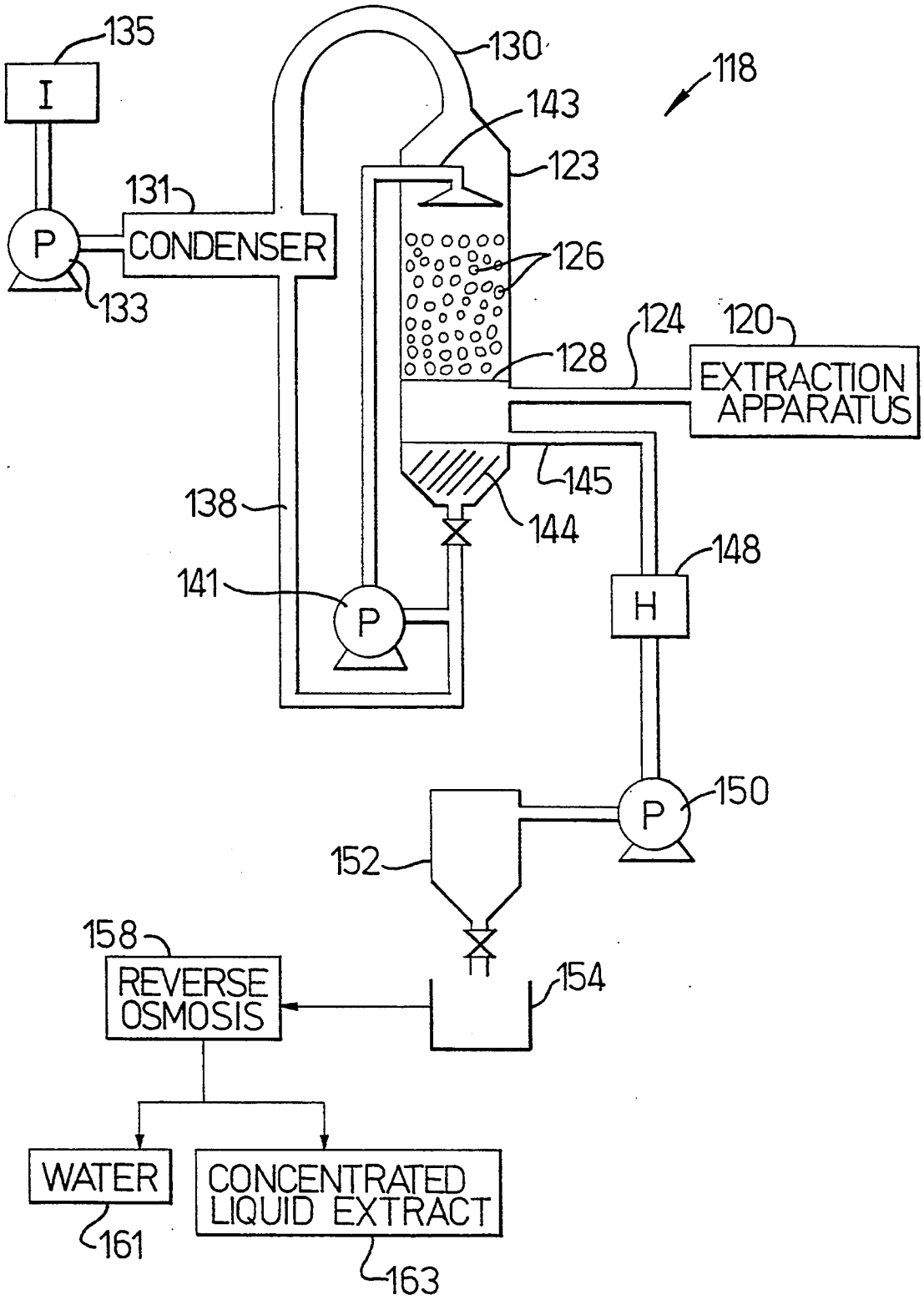
FIG. 2 is a schematic diagram of an apparatus for performing certain process steps of the present invention.

Referring to FIG. 2, there is shown an apparatus 118 for processing the previously described extract. Steam, ammonia, air and tobacco extract exhausted from extraction apparatus or treatment zone 120 (e.g., at about 195° F.) to the bottom region of a column stripper 123 through tube 124. The column is 123 packed with a plurality of fill 126, and a screen 128 prevents the fill from falling to the bottom region of the column. Exemplary fill or packing can have a "snowflake" or "saddle" shape. See, McCabe, et al., *Unit Operations of Chemical Engineering,* (3rd Ed.) pp 707–710. Exemplary column strippers and fill are described by McCabe, et al., in *Unit Operations of Chemical Engineering,* (3rd Ed.) pp. 410, 411. Vapor exits the upper region of the column and passes through tube 130 and through a condenser 131.

An exemplary condenser is a contact condenser or a shell and tube type heat exchange condenser available as S-1000-R from American Standard, Inc. Vapor in the form of ammonia and water exits the condenser and is transferred by a backward inclined radial blade fan 133 or other suitable means to an incinerator 135 or other means for disposing of the ammonia. Condensed liquid (e.g., at about 100° F.) exits the condenser 131 through tube 138 and is transported via pump 141 (e.g., a centrifugal pump) to be introduced into the upper region of column 123 using a spray nozzle 143 or other suitable application means. Tobacco extract and water are collected in liquid from 144 in the bottom region of column 123; and a portion of the liquid is recirculated through the column using pump 141 while remaining liquid exits overflow port 145 and is transferred to a heat exchanger 148 (e.g., a shell and tube heat exchange unit) to cool the liquid to a temperature of preferably about 100° F. or less. Cooled liquid then is transported via pump 150 (e.g., a peristaltic hose pump) to a storage tank 152. Liquid is removed from the storage tank 152 to a portable container 154.

The liquid which is removed from the storage tank 152 can be subjected to treatment sufficient to cause evaporation of water present therein. For example, the liquid is transferred to a reverse osmosis unit 158 or other unit for removing water from the liquid. An exemplary reverse osmosis unit is available as Sepratech from Separation Technology, Inc., equipped with reverse osmosis membranes (e.g., a Desal-3LP membrane) from Desalination Systems, Inc. As such, water is removed from the liquid and collected 161, and tobacco extract and water are also collected 163. See, *Perry's Chemical Engineers' Handbook,* (6th Ed.) edit. by Green, et al., pp. 17–22 through 17–27. Techniques such as wiped film evaporation techniques tend to cause removal of relatively high amounts of ammonia from the liquid; while techniques such as reverse osmosis techniques tend to cause significant amounts of ammonia to remain in contact with the liquid (e.g., so as to provide a liquid including about 4 to about 7 weight percent tobacco extract and about 0.1 to about 2 weight percent ammonia). Normally, the liquid is concentrated so as to include sufficient water such that the liquid includes less than about 10 weight percent tobacco extract, and frequently less than about 8 weight percent tobacco extract.

The liquid tobacco extract is contacted with a liquid having a boiling point which is significantly greater than that of water (i.e., which is significantly greater than 100° C.). Such a liquid preferably is a visible aerosol forming material. Exemplary visible aerosol forming materials include polyhydric alcohols, such as glycerine, triethylene glycol and propylene glycol. The amount of visible aerosol forming material which is contacted with the liquid tobacco extract can vary. Typically, the weight of visible aerosol forming material relative to that weight of the liquid tobacco extract ranges from about 4:1 to about 1:1, generally about 3:1 to about 2:1, and frequently about 1:1. Exemplary techniques for removing water from the mixture of liquid tobacco extract and visible aerosol forming material involve subjecting a mixture of visible aerosol forming material, water, ammonia and tobacco extract to rotary evaporation conditions under conditions of elevated temperature and fairly low pressure. As such, a mixture of more than about 80 weight percent visible aerosol forming material, less than about 10 weight percent tobacco extract, less than about 2 weight percent ammonia and less than about 10 percent water can be collected. Most preferably, the mixture is subjected to conditions of temperature and pressure sufficient to evaporate water therefrom, but such conditions are such that very little of the visible aerosol forming material is removed from the mixture.

After concentration, the mixture can be contacted with further tobacco extract, flavoring agents and further aerosol forming material. Exemplary flavoring agents will be apparent to the skilled artisan, and flavor packages can be mixed with the mixture. See, Leffingwell et al., *Tobacco Flavoring for Smoking Products,* (1972). Exemplary tobacco extracts are spray dried extracts, freeze dried extracts, tobacco essences, tobacco aroma oils, tobacco oleoresins, heat treated extracts, and the like. The extract can be dissolved or dispersed in a solvent (e.g., water) if desired. Exemplary tobacco extracts are described in U.S. Pat. No. 4,986,286 to Roberts et al.; U.S. Pat. No. 5,005,593 to Fagg; U.S. Pat. No. 5,060,669 to White et al.; U.S. Pat. No. 5,074,319 to White et al.; U.S. Pat. No. 5,121,757 to White et al.; and U.S. Pat. No. 5,131,415 to Munoz et al. When additional liquid solvent is contacted with the mixture of tobacco extract and visible aerosol forming material, the resulting mixture can be subjected to conditions sufficient to remove a significant amount of that solvent from that mixture. Typically, such resulting mixtures include about 50 to about 95, often about 60 to about 80, and frequently about 65 to about 75 weight percent visible aerosol forming material; about 3 to about 30, often about 10 to about 30, and frequently about 15 to about 30 weight percent tobacco extract; about 1 to about 10, often 2 to about 8, and frequently about 3 to about 7 weight percent water; less than about 2 and frequently less than about 1 weight percent ammonia; and less than about 30, often less than about 15, and frequently less than about 5 weight percent of any other optional additives which may have been incorporated into the mixture.

The following examples are provided in order to further illustrate the invention but should not be construed as limiting the scope thereof. Unless otherwise noted, all parts and percentages are by weight.

EXAMPLE 1

Burley tobacco strip is placed onto a conveyor belt and passes through a treatment zone treater which is enclosed using air locks but is maintained at atmospheric pressure. Into the enclosed treater, about $\frac{2}{3}$ of the distance downstream from the point that the tobacco strip is introduced, is introduced gaseous, anhydrous ammonia through a sprayer in a countercurrent manner relative to the tobacco strip at a rate of about 15 to about 60 pounds of ammonia per 1000 pounds of tobacco strip. Simultaneously, the tobacco strip is exposed to steam, introduced at the extreme opposite end of the treater from the point that the tobacco strip is introduced, in an amount of about 10 to about 30 pounds per pound of tobacco strip. The steam is introduced at a temperature of about 220° F. to 280° F. The tobacco strip is contacted, on average, with the ammonia for about 10 minutes and the steam for about 30 minutes. Extracted tobacco strip then is removed from the treater. The steam, ammonia, air and tobacco volatiles, which are extracted from the tobacco strip are collected in the manner described previously with reference to FIG. 2, so as to provide an extract having a composition of about 1 percent tobacco extract, about 0.3 percent ammonia, and the remainder water. The composition so provided (e.g., condensed liquid extract) is concentrated using reverse osmosis techniques to provide a liquid extract including about 7 percent tobacco extract, about 0.5 percent ammonia and about 92.5 percent water. Then, about 1 part of that liquid extract is contacted with about 2 parts glycerine (boiling point is 290° C.) to form a liquid mixture. Then, that liquid mixture is concentrated using a rotary evaporator operating at about 90° C. and about 27 mm Hg vacuum to evaporate off ammonia and water. The resulting tobacco extract liquid mixture has a tobacco extract content of about 3.9 percent, a water content of about 3.7 percent and a glycerine content of about 92.4 percent. Essentially all of the ammonia introduced to the extract during the extraction conditions is removed from the tobacco extract liquid mixture during the rotary evaporation concentration steps.

EXAMPLE 2

A tobacco extract liquid mixture consisting essentially of glycerine is provided, essentially as described in Example 1. About 1 part of that mixture is contacted with about 7 parts of a liquid tobacco extract. The liquid tobacco extract includes about 6.2 percent Burley tobacco extract and about 93.8 water, and is provided by extracting Burley tobacco parts with water at about 70° C. The resulting mixture of tobacco extracts, water and glycerine is concentrated using rotary evaporation techniques essentially as described in Example 1 to obtain a tobacco extract liquid mixture having a tobacco extract content of about 30 percent, a glycerine content of about 65 percent, and a water content of about 5 percent.

EXAMPLE 3

A tobacco extract liquid mixture is provided, essentially as described in Example 2. To that mixture is added further glycerine so as to provide a mixture of about 6 percent tobacco extract, about 93 percent glycerine and about 1 percent water.

What is claimed is:

1. A process for providing a tobacco extract comprising (a) providing a tobacco extract by contacting a tobacco material with a basic material comprising ammonia in the presence of an aqueous solvent; and separating aqueous solvent, basic material and tobacco extract from extracted tobacco material;

(b) contacting the aqueous solvent, basic material and tobacco extract with a liquid having a boiling point significantly greater than water to provide a mixture;

(c) subjecting the mixture to conditions sufficient to remove a significant amount of the aqueous solvent therefrom; and (d) collecting a mixture including tobacco extract and liquid having a boiling point significantly greater than water, such mixture consisting primarily of the liquid having a boiling point significantly greater than water.

2. The process of claim 1 whereby the liquid having a boiling point significantly greater than water is a visible aerosol forming material.

3. The process of claim 1 whereby the liquid having a boiling point significantly greater than water is a polyhydric alcohol.

4. The process of claim 1 whereby the aqueous solvent is employed in step (a) in the form of steam.

5. The process of claim 1 whereby the mixture collected in step (d) includes about 60 to about 80 weight percent solvent having a boiling point significantly greater than water, about 20 to about 30 weight percent tobacco extract, and about 2 to about 8 weight water.

* * * * *